US010480889B1

(12) United States Patent
Fan

(10) Patent No.: US 10,480,889 B1
(45) Date of Patent: Nov. 19, 2019

(54) FIREARM HAVING INTEGRAL RECOIL BOOSTER AND COMPENSATOR, AND QUICK DETACH SUPPRESSOR SYSTEM

(71) Applicant: Jason Fan, Henderson, NV (US)

(72) Inventor: Jason Fan, Henderson, NV (US)

( * ) Notice: Subject to any disclaimer, the term of this patent is extended or adjusted under 35 U.S.C. 154(b) by 0 days.

(21) Appl. No.: 16/503,193

(22) Filed: Jul. 3, 2019

Related U.S. Application Data

(62) Division of application No. 16/041,610, filed on Jul. 20, 2018.

(60) Provisional application No. 62/689,722, filed on Jun. 25, 2018.

(51) Int. Cl.
*F41A 21/32* (2006.01)

(52) U.S. Cl.
CPC ..... *F41A 21/325* (2013.01)

(58) Field of Classification Search
CPC ..... F41A 21/30; F41A 21/00; F41A 21/26; F41A 21/28; F41A 21/32; F41A 21/325; F41A 21/34; F41A 21/36; F41A 21/484
USPC ..... 89/14.4, 14.05, 14.1, 14.2, 14.3, 14.5; 42/97, 107; 181/223
See application file for complete search history.

(56) References Cited

U.S. PATENT DOCUMENTS

| | | | | |
|---|---|---|---|---|
| 8,272,306 | B1 * | 9/2012 | Smith | F41A 21/30 181/223 |
| 8,387,299 | B1 * | 3/2013 | Brittingham | F41A 21/30 42/90 |
| 9,500,427 | B1 * | 11/2016 | Larue | F41A 21/30 |
| 10,156,412 | B1 * | 12/2018 | Price | F41A 21/36 |
| 10,180,300 | B2 * | 1/2019 | Schirmer | F41A 21/36 |
| 10,184,744 | B2 * | 1/2019 | Young | F41A 21/325 |
| 2011/0067950 | A1 * | 3/2011 | Shults | F41A 21/30 181/223 |
| 2011/0088540 | A1 * | 4/2011 | Brittingham | F41A 21/26 89/14.5 |
| 2012/0279381 | A1 * | 11/2012 | Landolt | F41A 21/30 89/14.4 |
| 2017/0167816 | A1 * | 6/2017 | Young | F41A 21/325 |
| 2018/0128566 | A1 * | 5/2018 | Reis Green | F41A 21/30 |
| 2018/0245872 | A1 * | 8/2018 | Jen | F41A 21/325 |

* cited by examiner

*Primary Examiner* — John Cooper
(74) *Attorney, Agent, or Firm* — FisherBroyles, LLP; Rob L. Phillips

(57) ABSTRACT

A firearm having an integral recoil booster including a pair of bushings and spring positioned to interact with an integral firearm compensator; a quick detach mount for one or more suppressor baffles; and one or more suppression baffles. As configured, the integral recoil booster also generates additional force ensuring contact at a slide/barrel interface. A monolithic suppressor may also be used with the quick detach mount.

10 Claims, 16 Drawing Sheets

FIREARM HAVING INTEGRAL RECOIL BOOSTER AND COMPENSATOR, AND QUICK DETACH SUPPRESSOR SYSTEM

CROSS-REFERENCE

This application is a divisional application of, and claims priority to, U.S. patent application Ser. No. 16/041,610 filed Jul. 20, 2018 which claims priority to U.S. Patent Application No. 62/689,722 filed Jun. 25, 2018 and incorporated herein for all purposes.

FIELD OF THE INVENTION

The embodiments of the present invention relate to a firearm having an integrated recoil booster facilitating a quick detach suppressor system and smaller suppressor.

BACKGROUND

Recoil boosters (aka Neilson device) are well known in the art. Recoil boosters allow the added weight and inertia of a suppressor to be decoupled from a semi-automatic handgun so that the handgun functions properly with the suppressor attached thereto. Recoil boosters also function as compensators. Suppressors are often attached to the barrel of the firearm in a threaded arrangement.

It would be advantageous to develop an integrated recoil booster for a family of handguns (e.g., Glock) that facilitates a quick detach suppressor system improving upon the conventional threaded arrangement. Moreover, integrating the recoil booster into the firearm reduces the size of the corresponding suppressor.

SUMMARY

Accordingly, a first embodiment of the present invention comprises a firearm having an integral recoil booster including a pair of bushings and spring positioned to interact with an integral firearm compensator; a quick detach mount for one or more suppressor baffles; and one or more suppression baffles. As configured, the integral recoil booster also generates additional force ensuring contact at the slide/barrel interface and acts as a compensator.

Other variations, embodiments and features of the present invention will become evident from the following detailed description, drawings and claims.

DETAILED DESCRIPTION

Figure 1A:
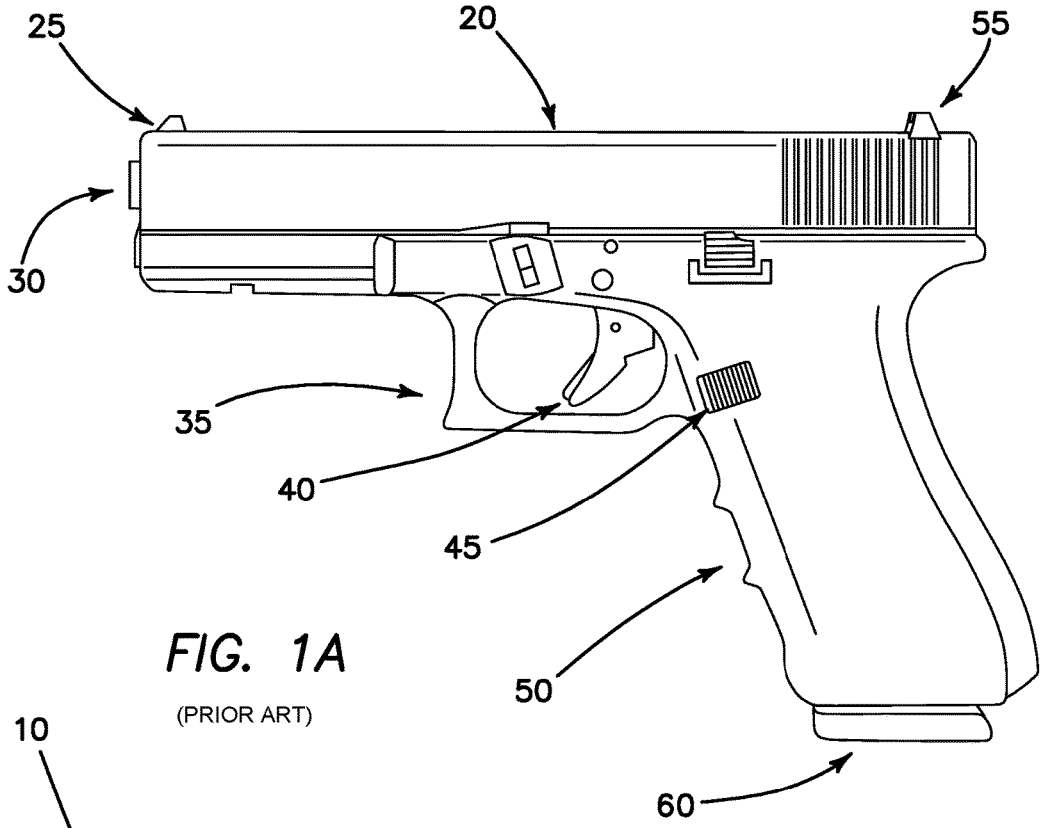
FIG. 1A (PRIOR ART)
FIGS. 1A through 1C illustrate Glock 17, Glock 19 and Glock 19X firearms, respectively.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The components of the present invention may be made using any suitable materials including, but not limited to, alloys, composites, metals, polymers, ceramics, plastics and combinations thereof. The components of the present invention may be fabricated using any suitable technique including, but not limited to, milling, machining, molding, 3D printing and combinations thereof.

Figure 1B:
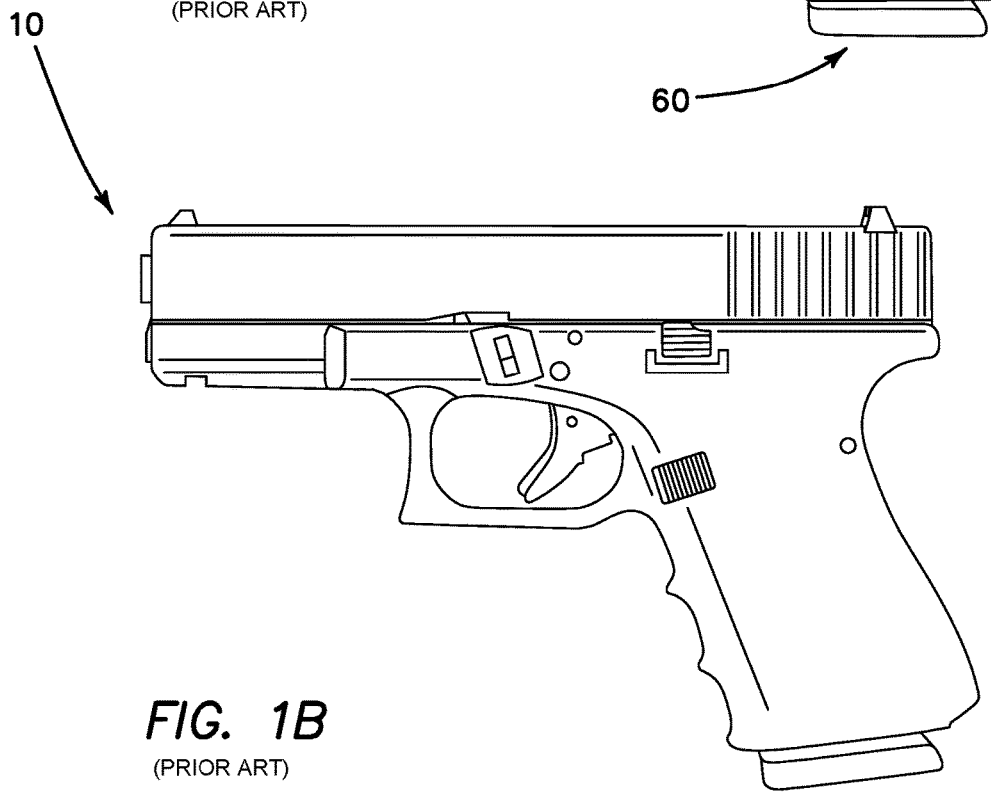
FIG. 1B (PRIOR ART)
Figure 1C:
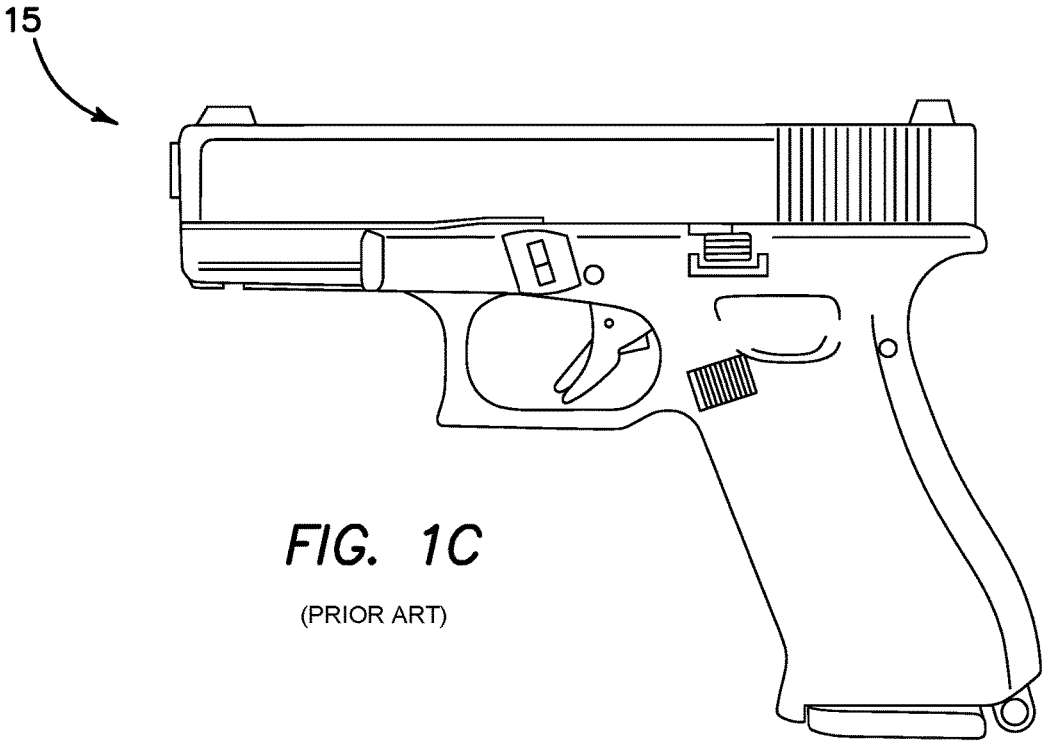
FIG. 1C (PRIOR ART)

FIGS. 1A through 1C show Glock 17, 19 and 19X firearms 5-15 of the type with which the embodiments of the present invention may be used. FIG. 1A also depicts the basic parts of a handgun comprising the slide 20, front sight 25, barrel 30, trigger guard 35, trigger 40, magazine release 45, frame/grip 50, slide lock 55 and rear sight 60. A magazine 65 is inserted into the grip 50 in a conventional manner.

Figure 2B:
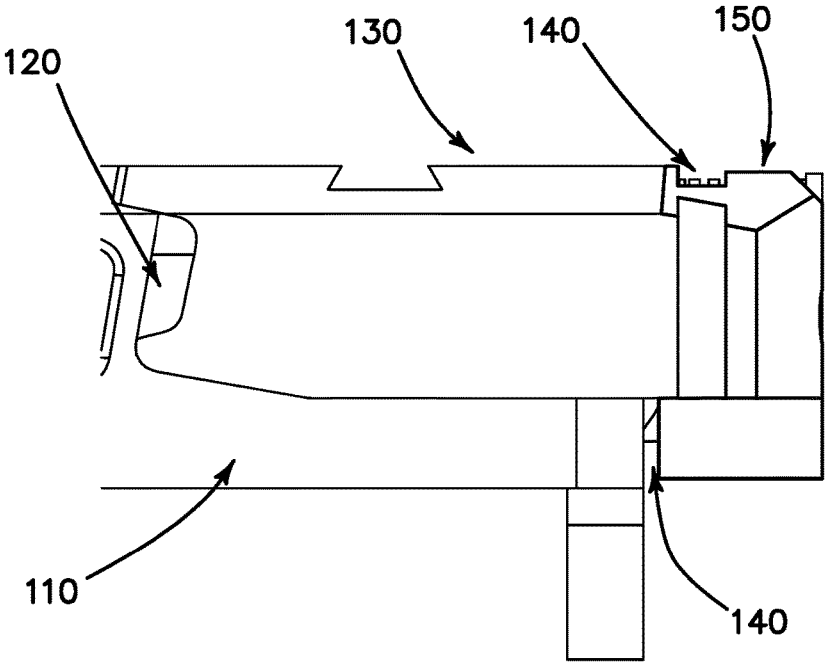
FIGS. 2A and 2B illustrate side views of a slide and barrel assembly having an integral recoil booster and compensator according to the embodiments of the present invention.
Figure 2A:
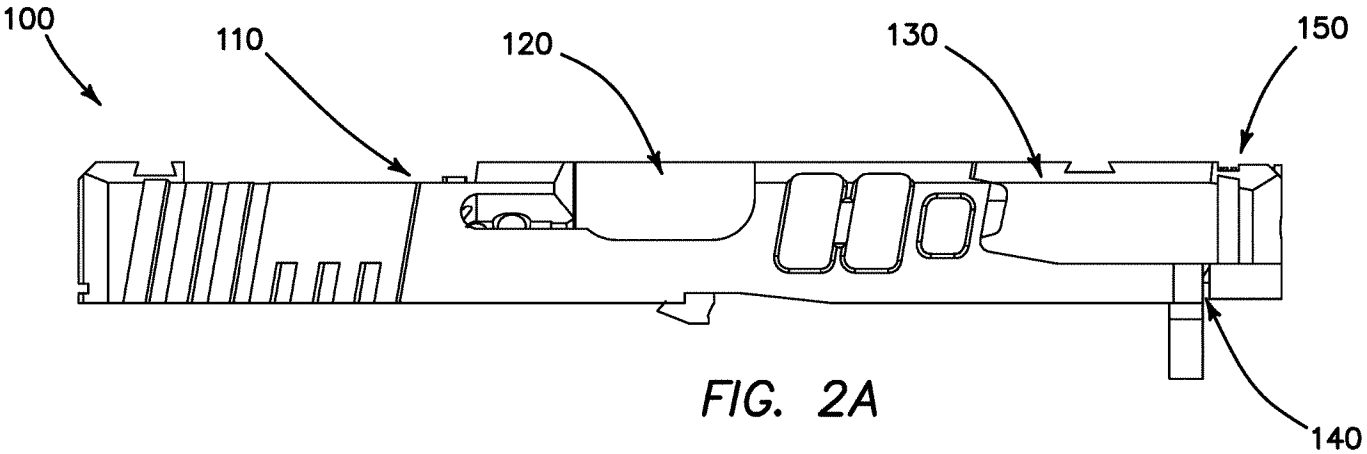

FIGS. 2A and 2B show a side view of a slide and barrel assembly 100 having an integral compensator and recoil booster according to the embodiments of the present invention. In broad terms, the slide and barrel assembly 100 includes a slide 110, barrel 120, compensator 130, recoil booster 140 and suppressor quick detach mount 150. In this embodiment, the barrel 120 is removed via the front of the slide 110 allowing for the integration of the compensator 130, recoil booster 140 (only partially visible in FIGS. 2A and 2B as it is internal to the compensator 130 and suppressor quick detach mount 150) and suppressor quick detach mount 150.

Figure 3A:
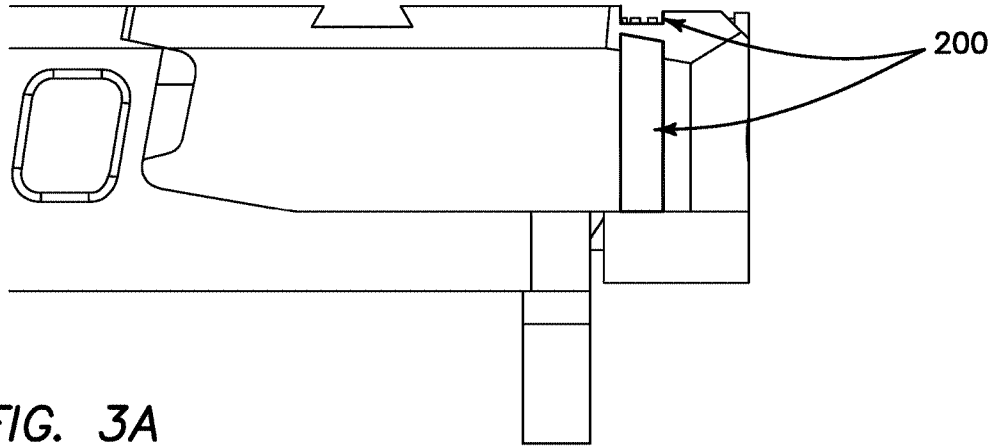
FIGS. 3A and 3B illustrate views of a locking recess for a quick detach suppressor according to the embodiments of the present invention.
Figure 3B:
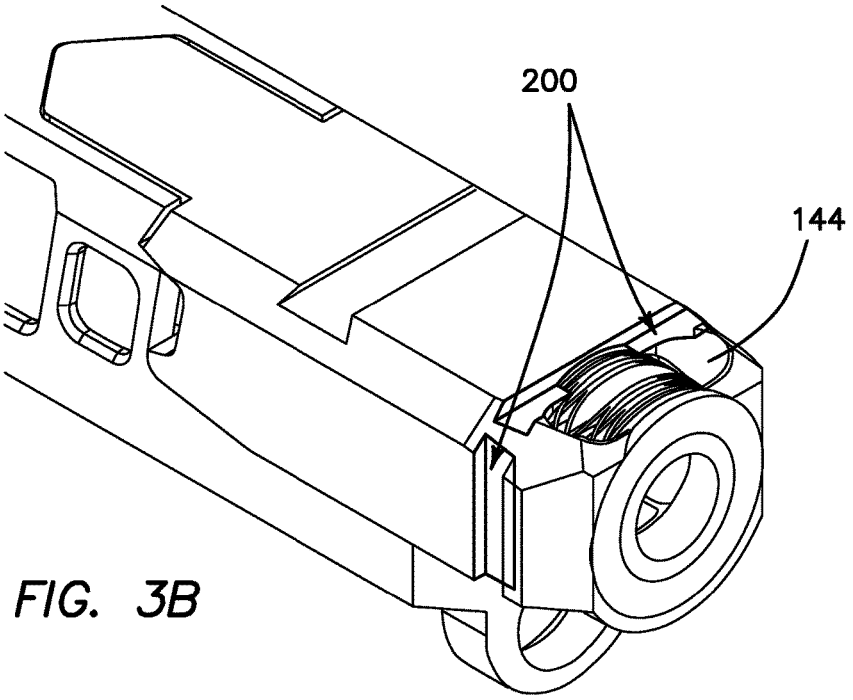

FIGS. 3A and 3B illustrate views of a locking recess 200 for attachment of the suppressor quick detach mount 150 according to the embodiments of the present invention. As shown, the locking recess 200 comprises a series of grooves (along top and both vertical sides) on the compensator 130. As set forth in more detail below, the grooves 200 allow the suppressor quick detach mount 150 to be connected to, and removed from, the compensator 130.

Figure 4:
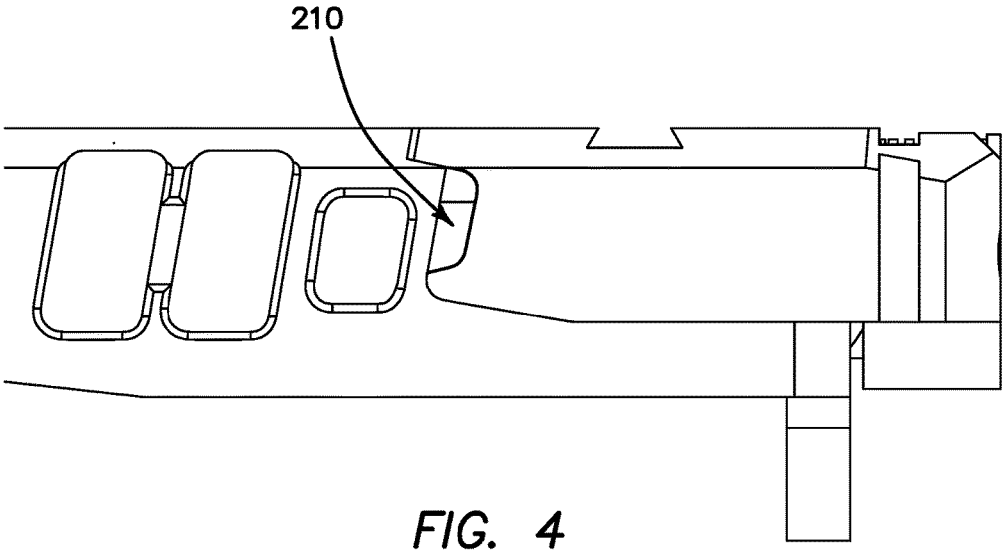
FIG. 4 illustrates a debris cutout according to the embodiments of the present invention.

FIG. 4 shows a debris cutout 210 near an interface of the barrel 120 and slide 110 according to the embodiments of the present invention. The cutout 210 permits debris to escape. The cutout 210 also functions to eliminate any pinching effect on the user as the barrel 120 and slide 110 separate slightly during firing. While only one cutout 210 is shown, an identical cutout is positioned on the opposite side of the firearm.

Figure 5:
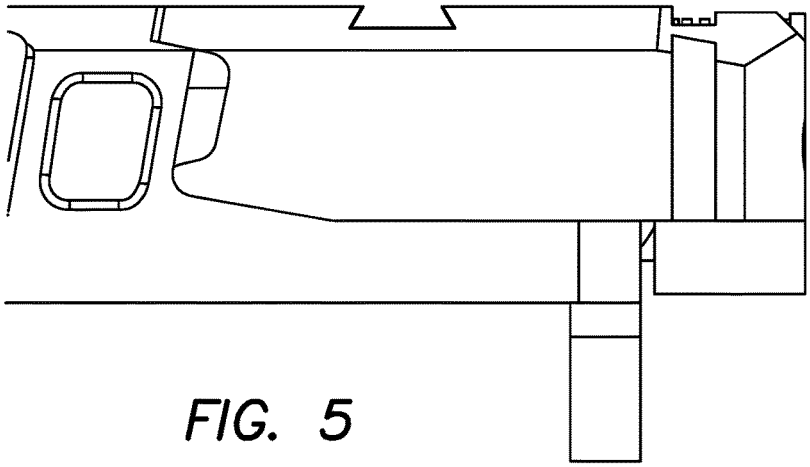
FIG. 5 illustrates a side view of a front sight dovetail according to the embodiments of the present invention.

FIG. 5 shows a side view of a front sight dovetail 220 according to the embodiments of the present invention. The front sight dovetail 220 accepts the front sight of the firearm.

Figure 6A:
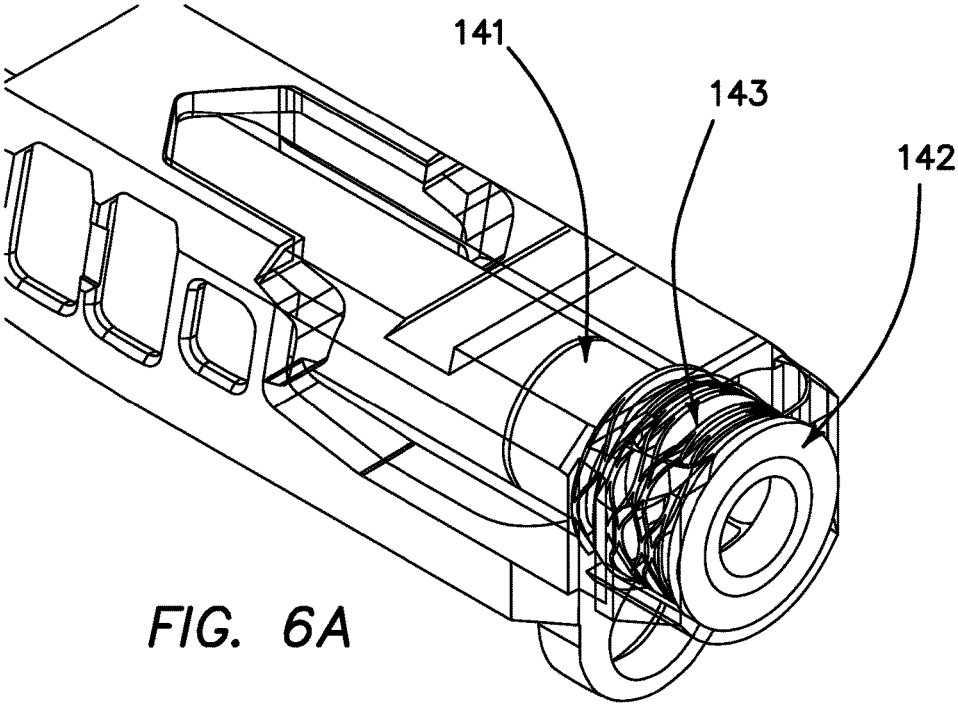
FIGS. 6A through 6C illustrate the recoil booster according to the embodiments of the present invention.
Figure 6B:
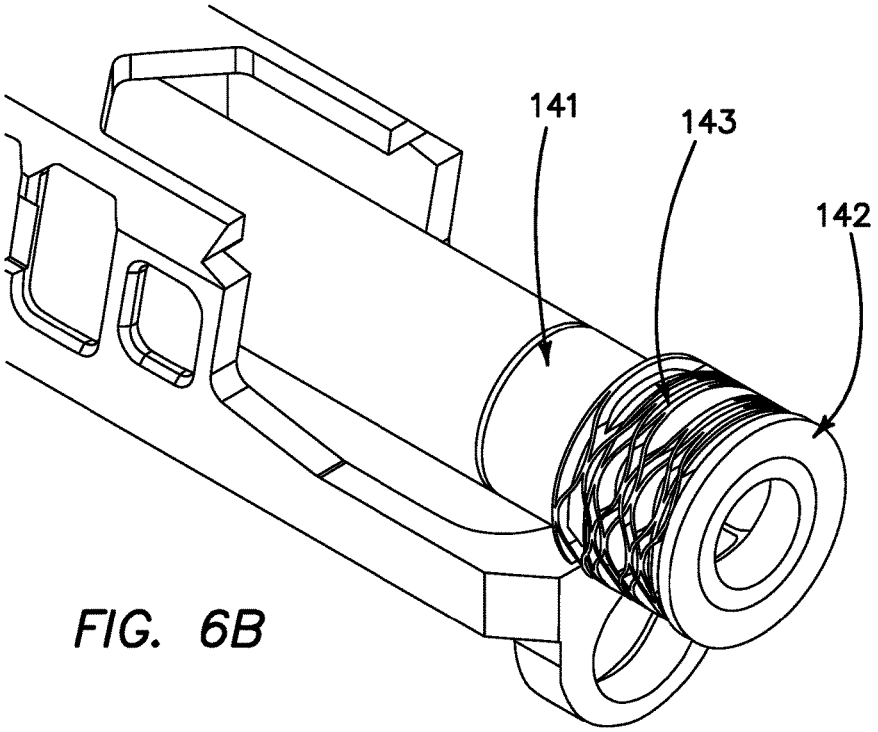
Figure 6C:
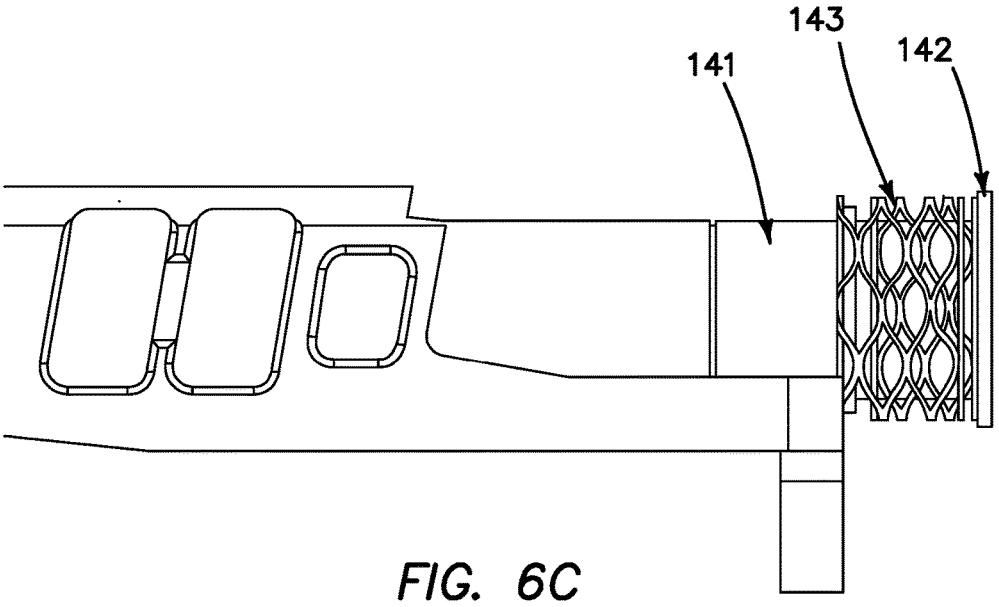

FIGS. 6A through 6C show the recoil booster 140 according to the embodiments of the present invention. The recoil booster 140 comprises a pair of bushings 141, 142 and a spring 143 (e.g., wave or waffle spring). Bushing 142 is positioned forward of bushing 141. The integral recoil booster 140 serves to decouple the weight of the suppressor when connected to the suppressor quick detach mount 150 in the same manner as a convention recoil booster or Neilson device.

Figure 7:
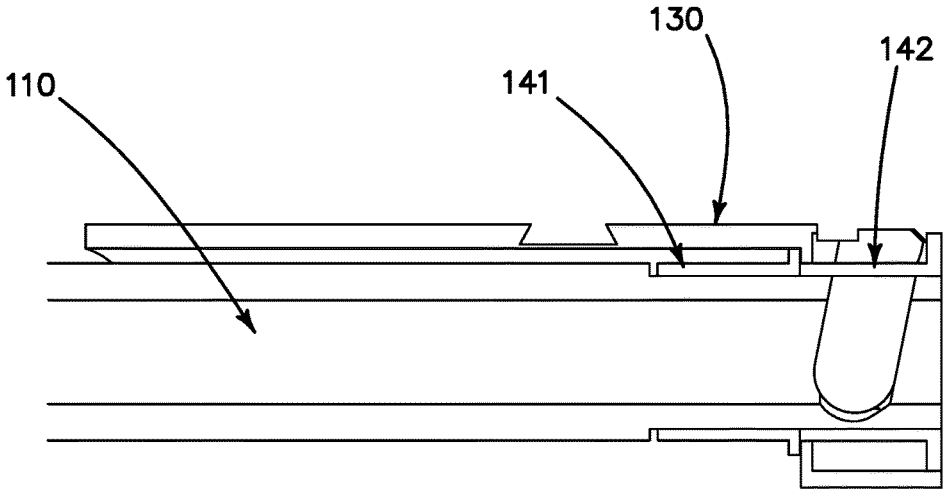
FIG. 7 illustrates a cross-sectional view of the recoil booster with the spring removed according to the embodiments of the present invention.

FIG. 7 shows a cross-sectional view of the recoil booster 140 with the spring 143 removed according to the embodiments of the present invention. When in place, the spring 143 fits around and sits on the bushing 142 and may extend over bushing 141 and compresses against an internal pocket 144 of the compensator 130 when activated.

Figure 8:
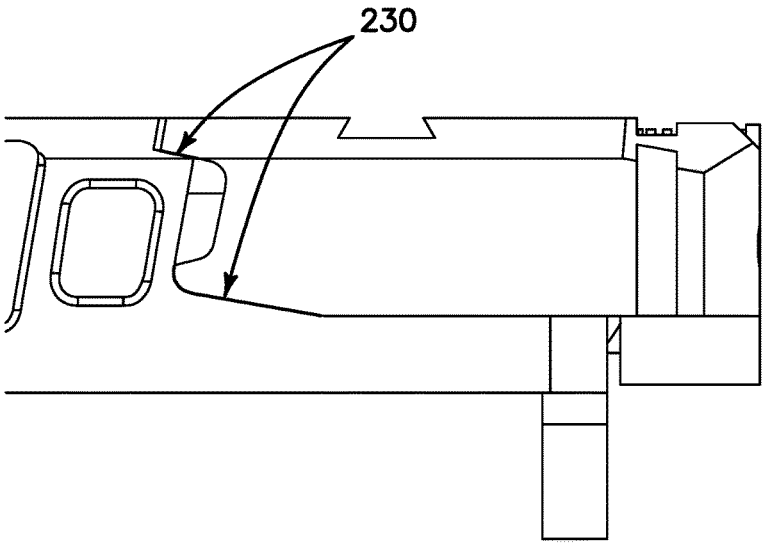
FIG. 8 illustrates a side view of a slide and barrel interface according to the embodiments of the present invention.

FIG. 8 shows a side view of a slide and barrel interface 230 according to the embodiments of the present invention. The spring 143 of the recoil booster 140 maintains an active and positive lock up.

Figure 9A:
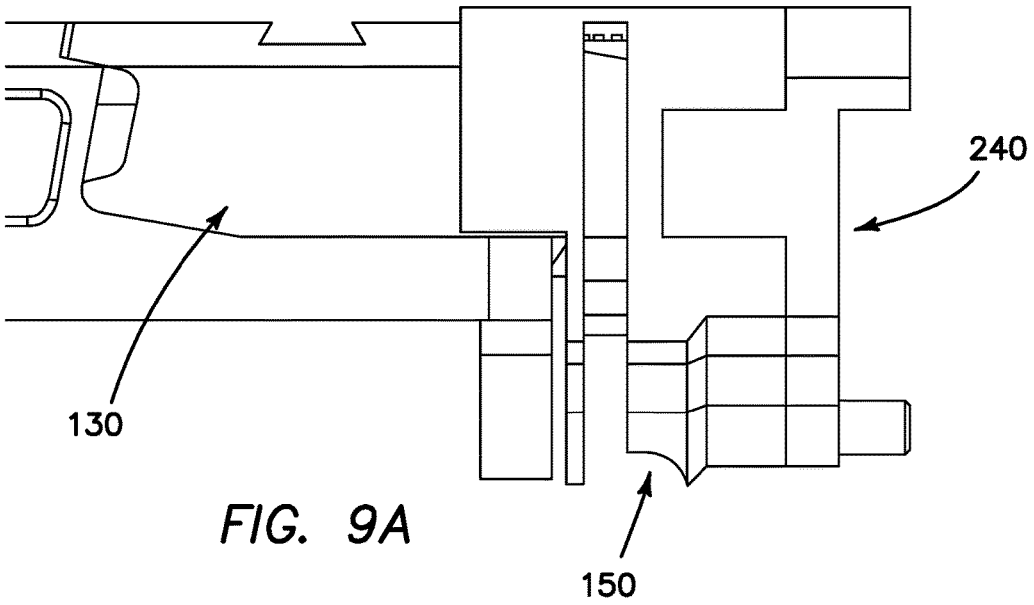
FIGS. 9A through 9C illustrate views of a suppressor quick detach mount according to the embodiments of the present invention.
Figure 9B:
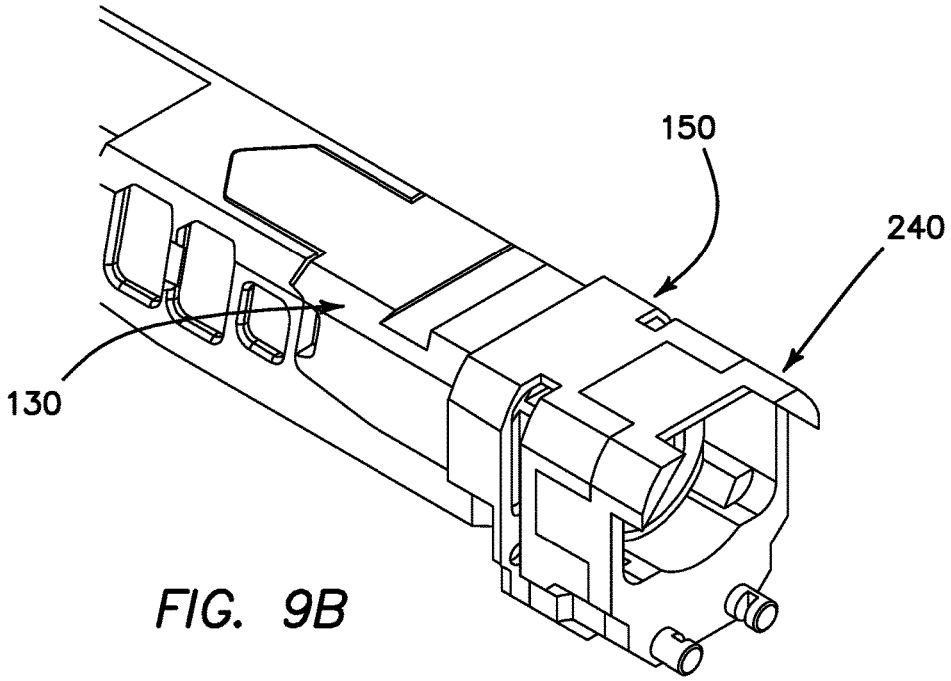
Figure 9C:
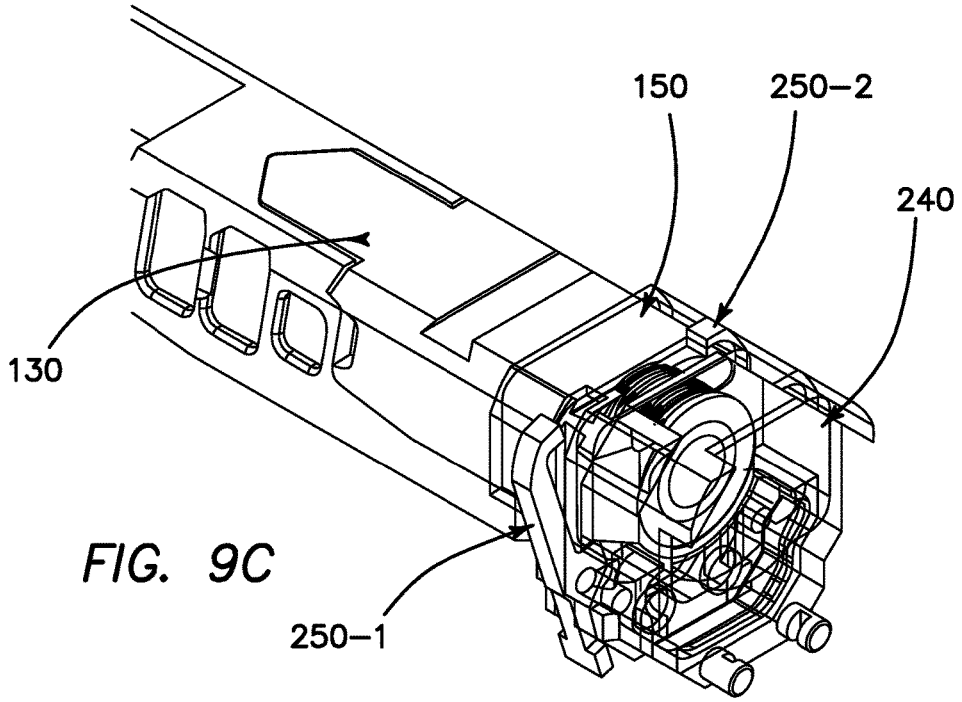
Figure 10:
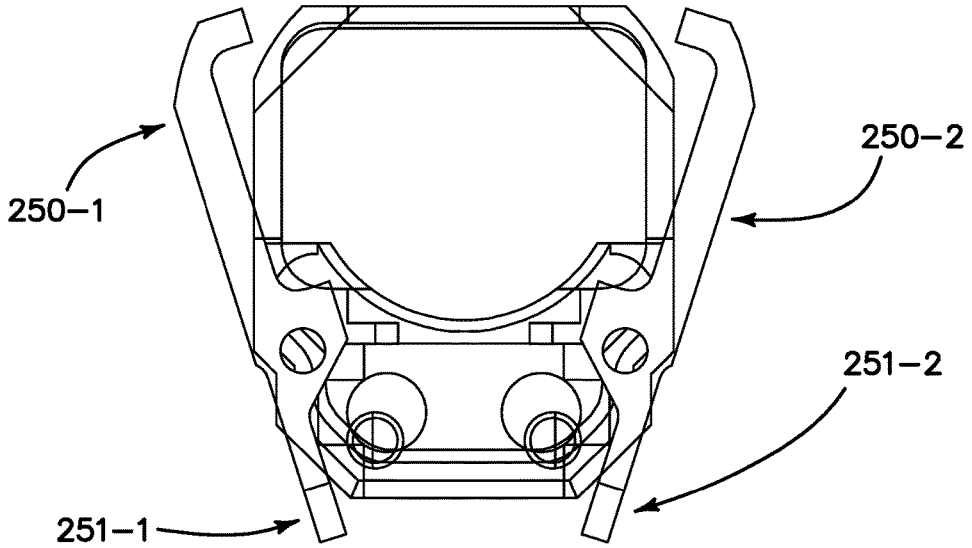
FIG. 10 illustrates a rear view of the suppressor quick detach mount with mounting claws in open position according to the embodiments of the present invention.

FIGS. 9A through 9C shows views of the suppressor quick detach mount 150 according to the embodiments of the present invention. The suppressor quick detach mount 150 fits over the compensator 130 as shown in FIGS. 9A and 9B. Locking claws 250-1 (open) and 250-2 (closed) shown in FIG. 9C (not shown in FIGS. 9A and 9B) and 10 lock the suppressor quick detach mount 150 in place on the compensator 130 via locking recess 200. Applying inward pressure to the bottoms 251-1, 251-2 of the locking claws 250-1, 250-2 (i.e., pinching them) disengages them from the compensator 130 for quick removal. In one embodiment, the locking claws 250-1, 250-2 are spring-biased in position on the compensator 130. Other forms of mechanical pressure (e.g., clamps, clasps, magnets, etc.) may be used to maintain the suppressor quick detach mount 150 in place on the compensator 130. A single suppressor baffle 240 is connected to the suppressor quick detach mount 150. The single suppressor baffle 240 includes means to attach a second suppressor baffle and so on such that the user is able to dictate how many suppressor baffles to attach based on desired noise suppression and gun length. A monolithic suppressor may also be used with the embodiments of the present invention.

Figure 11:
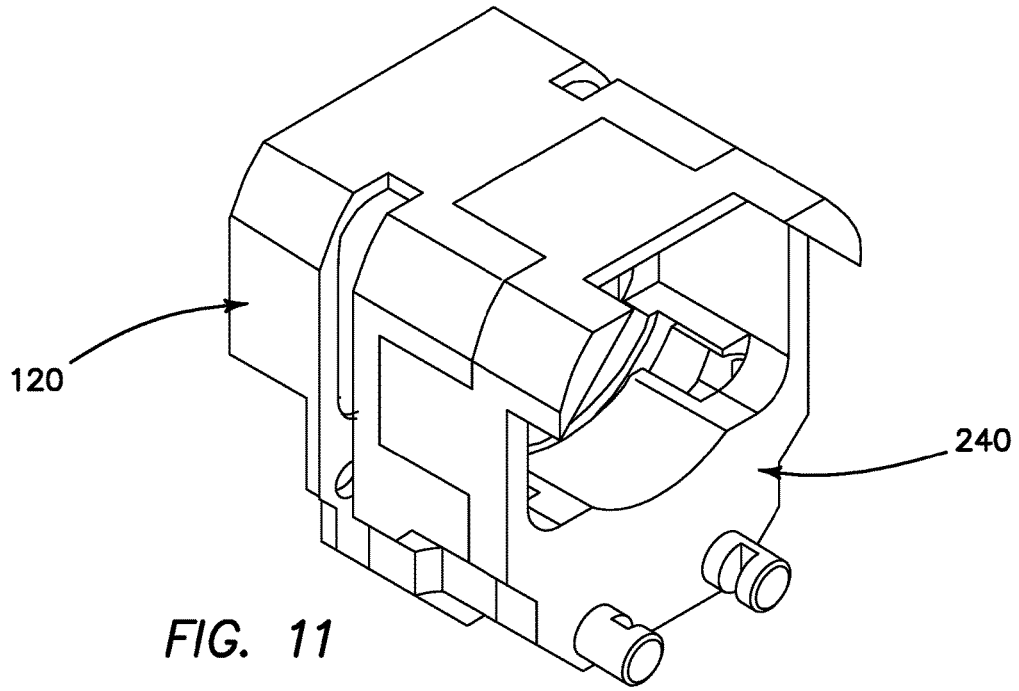
FIG. 11 illustrates the suppressor quick detach mount with mounting claws removed and one suppressor baffle attached according to the embodiments of the present invention.
Figure 12:
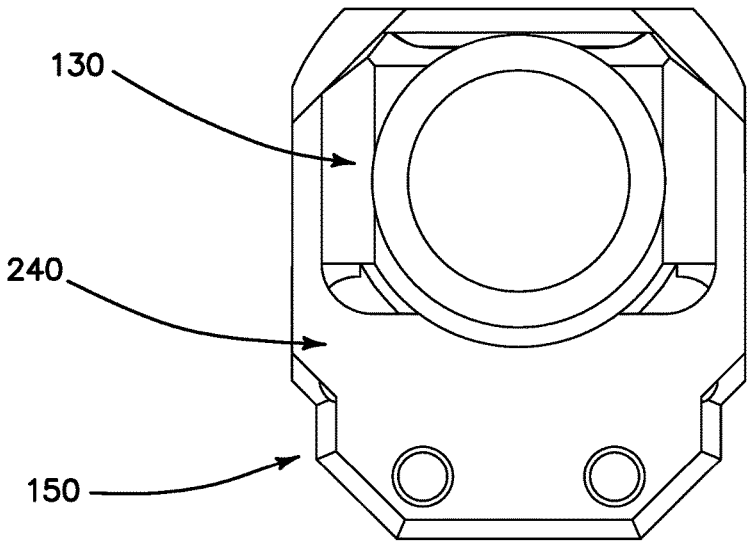
FIG. 12 illustrates a front view of the suppressor quick detach mount and suppressor baffle attached to the compensator according to the embodiments of the present invention.
Figure 13:
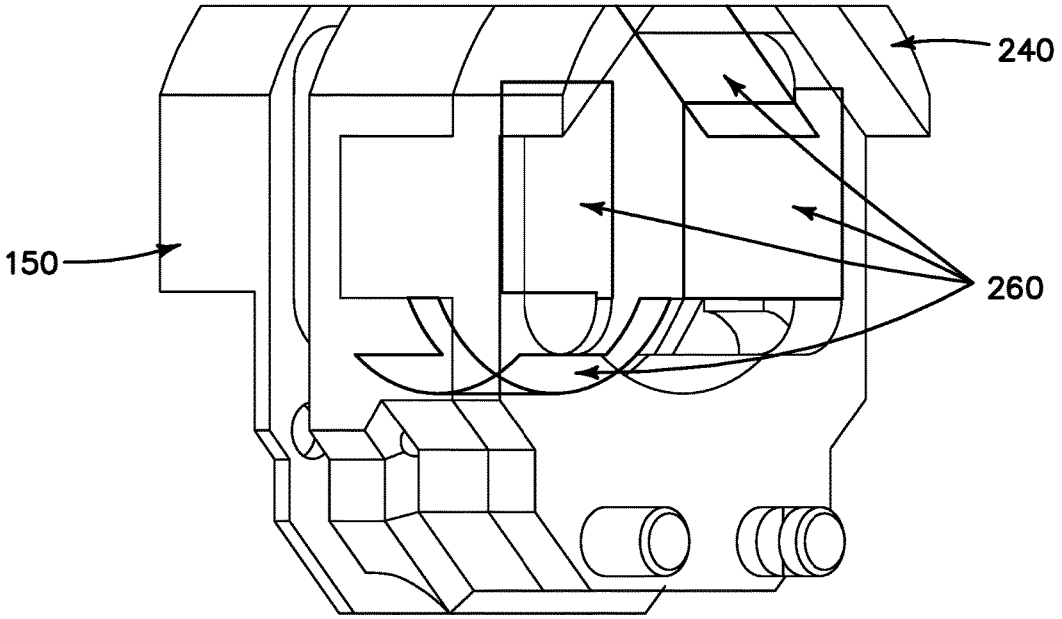
FIG. 13 illustrates the interaction between the suppressor quick detach mount and suppressor baffle when connected to one another according to the embodiments of the present invention.

FIG. 11 shows the suppressor quick detach mount 150 with mounting claws 250-1, 250-2 removed and one suppressor baffle 240 attached according to the embodiments of the present invention. FIG. 12 illustrates a front view of the suppressor quick detach mount 150 and suppressor baffle 240 attached to the compensator 130 according to the embodiments of the present invention. FIG. 13 illustrates the interaction surfaces 260 between the suppressor quick detach mount 150 and suppressor baffle 240 when connected to one another according to the embodiments of the present invention.

Figure 14A:
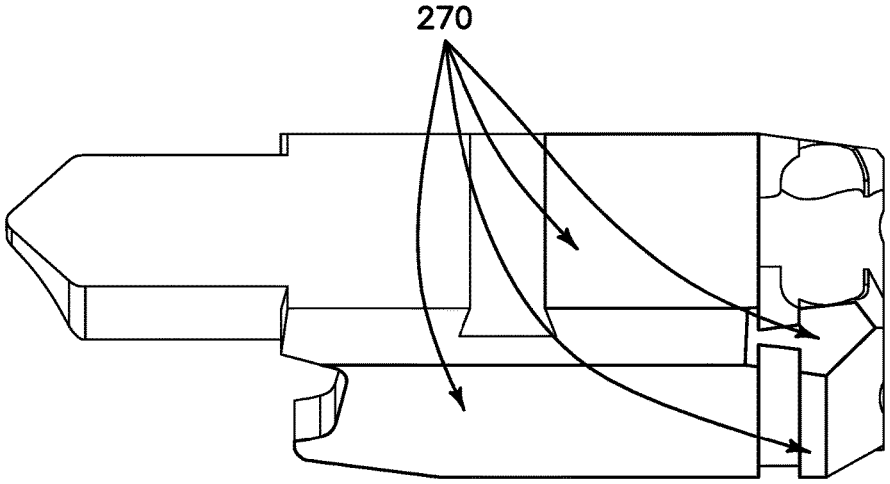
FIGS. 14A and 14B illustrate suppressor quick detach mount interface surfaces with the compensator according to the embodiments of the present invention.
Figure 14B:
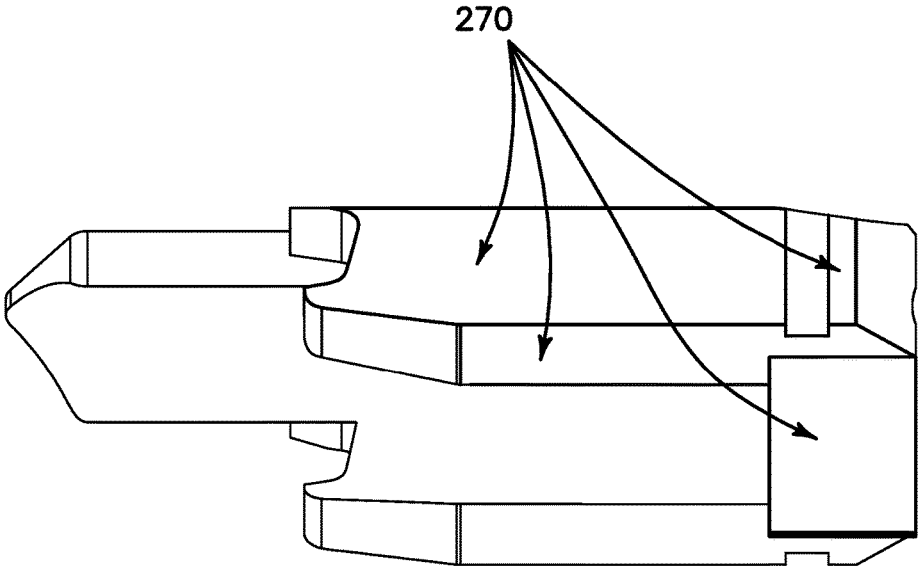

FIGS. 14A and 14B show interface surfaces 270 between the suppressor quick detach mount 150 and compensator 130 when connected to one another according to the embodiments of the present invention.

Figure 15:
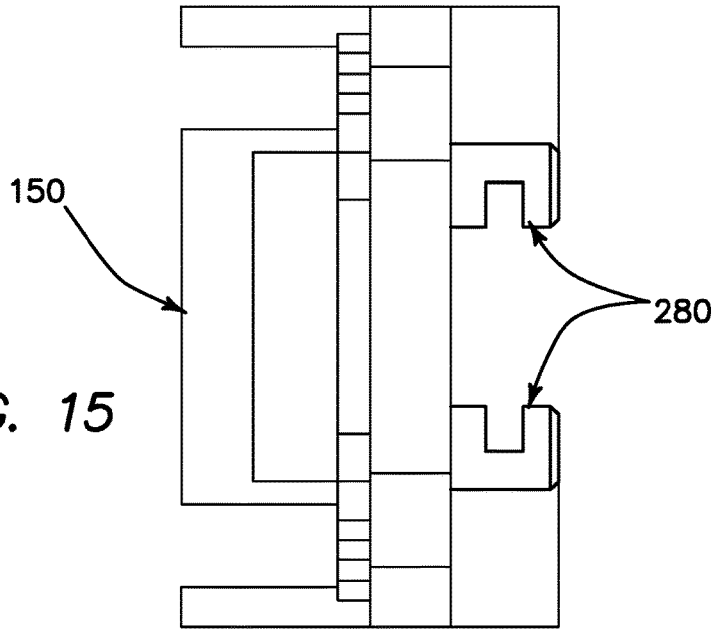
FIG. 15 shows a bottom of the suppressor baffle with an interface between the suppressor quick detach mount and a suppressor baffle highlighted according to the embodiments of the present invention.

FIG. 15 shows a bottom of the suppressor baffle with the interface 280 between the suppressor quick detach mount 150 and suppressor baffle 240 highlighted.

Figure 16A:
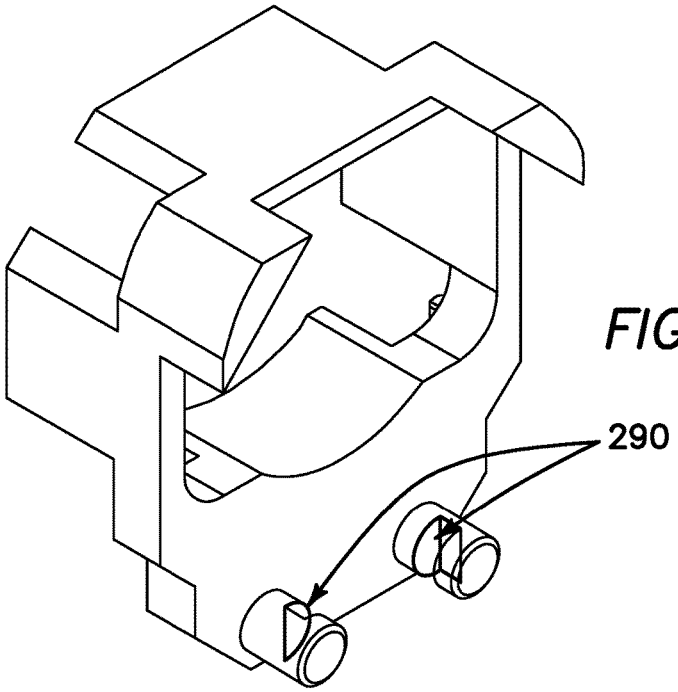
FIGS. 16A through 16C illustrate a suppressor baffle according to the embodiments of the present invention.
Figure 16B:
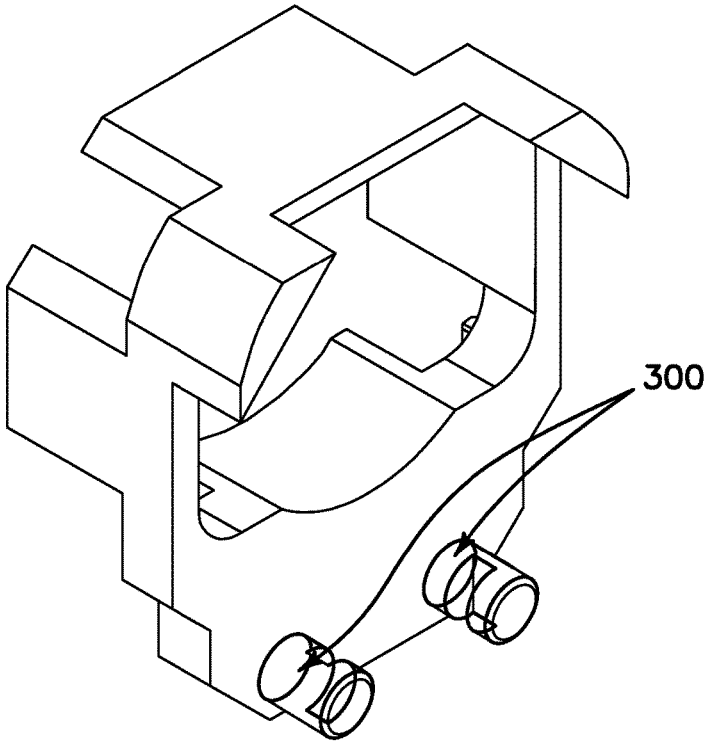
Figure 16C:
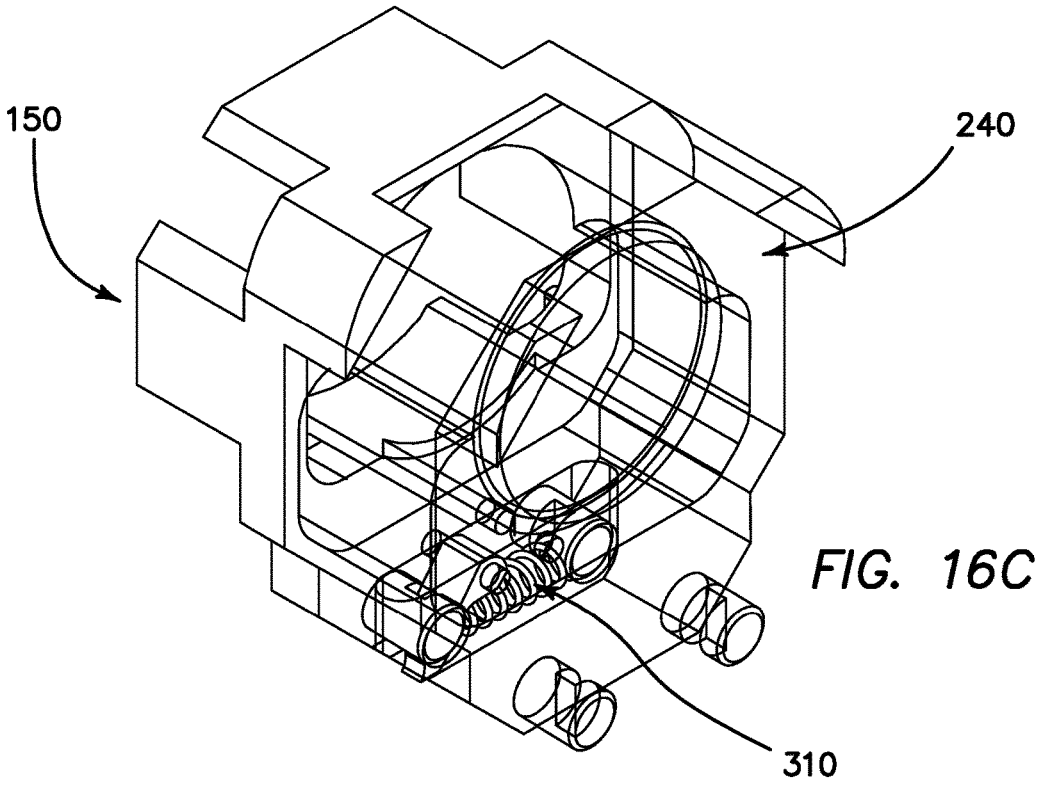

FIGS. 16A through 16C show a suppressor baffle 240 according to the embodiments of the present invention. FIG. 16A shows keyways 290 on the interface surface of the suppressor baffle 240. FIG. 16B shows nub surfaces 300 on the interface surface of the suppressor baffle 240. FIG. 16C shows a transparent suppressor baffle 240 attached to the suppressor quick detach mount 150. A locking mechanism 310 locking the suppressor quick detach mount 150 and suppressor baffle 240 is visible.

Figure 17A:
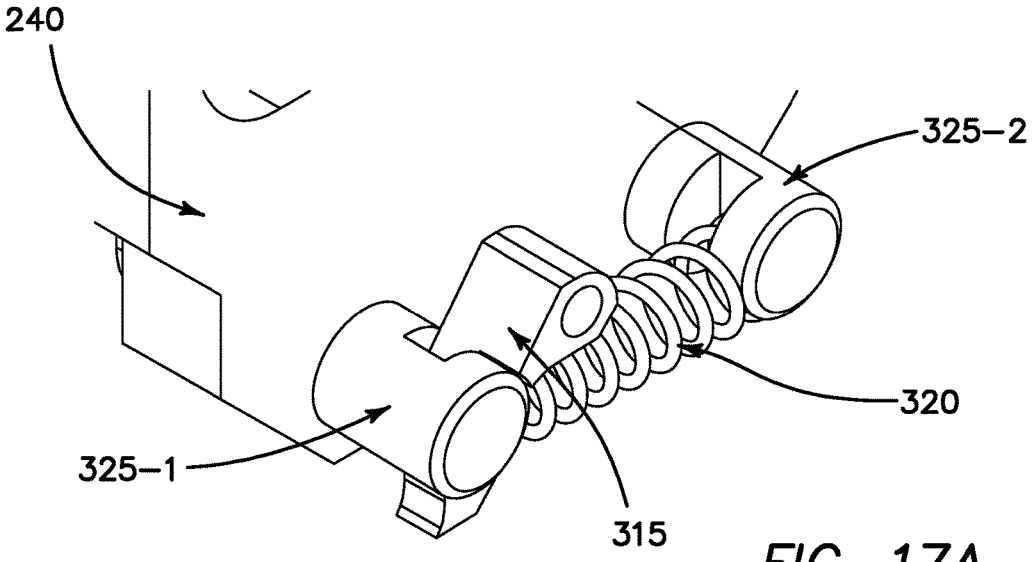
FIGS. 17A through 17C illustrate a suppressor baffle locking mechanism according to the embodiments of the present invention.
Figure 17B:
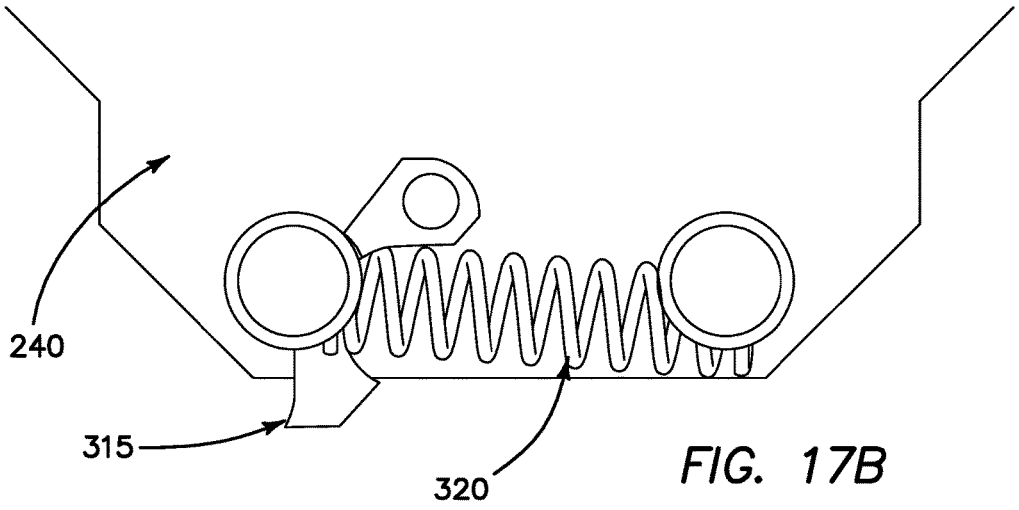
Figure 17C:
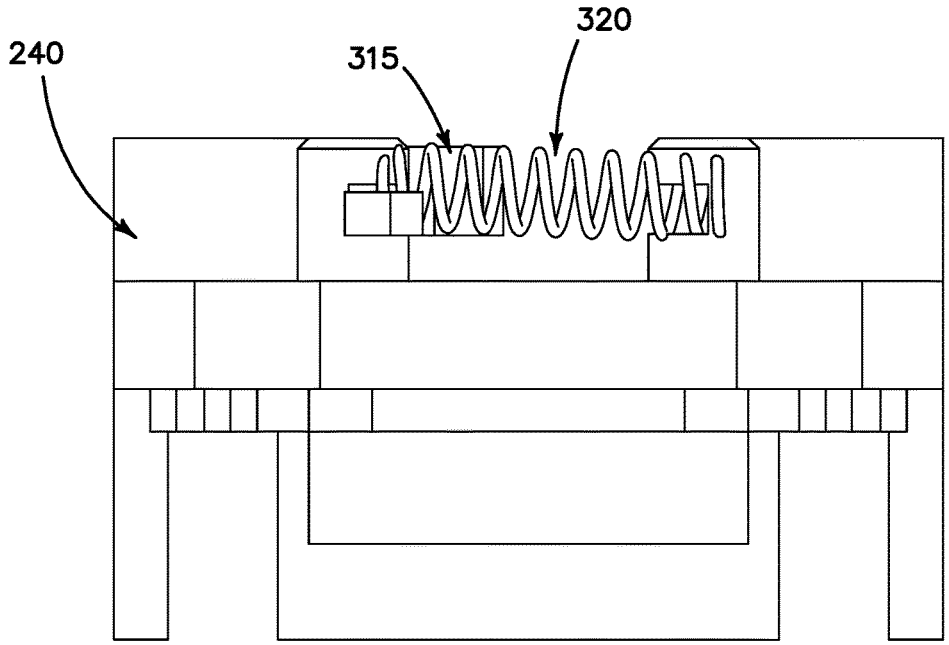

FIGS. 17A through 17C illustrate the suppressor baffle locking mechanism 310 according to the embodiments of the present invention. The locking mechanism 310 includes a locking finger 315 and spring 320. In another embodiment, there are two locking fingers, one on the left nub 325-1 (as shown) and one on the right nub 325-2.

Figure 18:
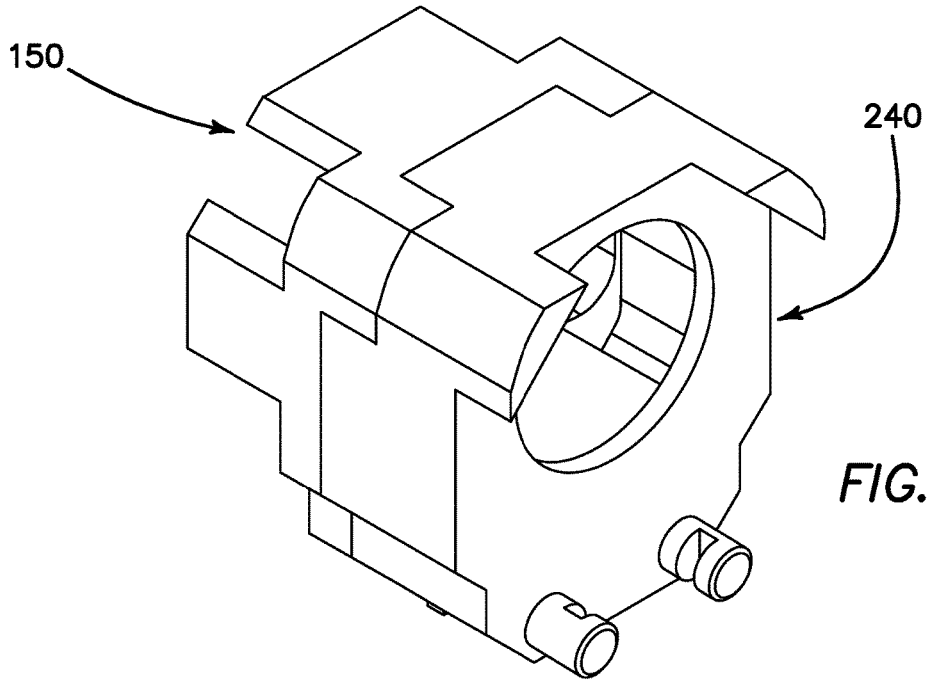
FIG. 18 illustrates a front view of a single suppressor baffle attached according to the embodiments of the present invention.
Figure 19:
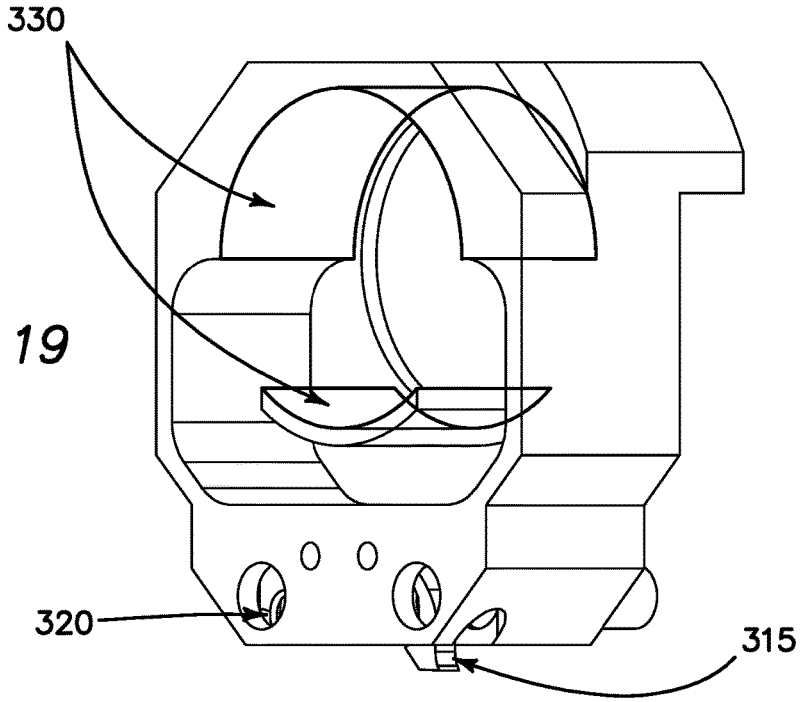
FIG. 19 illustrates a rear view of a suppressor baffle according to the embodiments of the present invention.

FIG. 18 shows a front view of a single suppressor baffle 240 attached to the suppressor quick detach mount 150 according to the embodiments of the present invention. Another suppressor baffle may be attached to suppressor baffle 240 using the same locking mechanisms that used to connect suppressor baffle 240 to the suppressor quick detach mount 150 (locking fingers and spring not shown). FIG. 19 shows a rear view of the suppressor baffle 240 according to the embodiments of the present invention. A suppressor baffle cone interface 330 is highlighted.

Although the invention has been described in detail with reference to several embodiments, additional variations and modifications exist within the scope and spirit of the invention as described and defined herein.

I claim:

1. A firearm comprising:

a recoil booster including a front bushing, rear bushing and a spring positioned about at least said front bushing, said recoil booster positioned within a compensator; and a quick detach mount removably attached to said compensator and configured to receive a suppressor baffle, said quick detach mount including a pair of mounting claws removably attaching said quick detach mount to said compensator.

2. The firearm of claim 1 wherein said compensator includes a series of grooves configured to receive said mounting claws.

3. The firearm of claim 1 wherein said compensator includes a pair of debris cutouts.

4. The firearm of claim 1 wherein said pair of mounting claws are spring-biased.

5. The firearm of claim 1 wherein said compensator includes one or more locking fingers and a spring configured to receive said suppressor baffle.

6. A firearm comprising:

a recoil booster including a front bushing, rear bushing and a spring positioned about at least said front bushing, said recoil booster positioned within a compensator;

a quick detach mount removably attached to said compensator;

a first suppressor baffle attached to said quick detach mount.

7. The firearm of claim 6 wherein said quick detach mount includes a pair of mounting claws configured to lock on said compensator.

8. The firearm of claim 7 wherein said compensator includes a series of grooves configured to receive said pair of mounting claws.

9. The firearm of claim 6 wherein said first suppressor baffle includes one or more locking fingers and a spring configured to receive and connect to a second suppressor baffle.

10. The firearm of claim 6 wherein said compensator includes one or more locking fingers and a spring configured to receive and connect to a suppressor baffle.

* * * * *